US008662150B2

(12) United States Patent
Kippel et al.

(10) Patent No.: US 8,662,150 B2
(45) Date of Patent: Mar. 4, 2014

(54) HEAT EXCHANGER MEDIA PAD FOR A GAS TURBINE

(75) Inventors: Bradly Aaron Kippel, Greer, SC (US); Jianmin Zhang, Greer, SC (US); Lisa Kamdar Ammann, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 110 days.

(21) Appl. No.: 12/852,783

(22) Filed: Aug. 9, 2010

(65) Prior Publication Data

US 2012/0031596 A1 Feb. 9, 2012

(51) Int. Cl.
*F28F 3/00* (2006.01)
*F28B 3/00* (2006.01)

(52) U.S. Cl.
USPC ..... 165/166; 165/113

(58) Field of Classification Search
CPC ... F28D 9/0025; F28D 9/0031; F28D 9/0037; F28D 1/03; F28D 1/0308
USPC ..... 165/165, 166, 167, 168, 169, 170, 148, 165/153, 113, 149; 261/100, 101
See application file for complete search history.

(56) References Cited

U.S. PATENT DOCUMENTS

| | | | | |
|---|---|---|---|---|
| 2,462,421 | A * | 2/1949 | Pitt | 165/81 |
| 4,270,602 | A * | 6/1981 | Foster | 165/167 |
| 4,544,513 | A * | 10/1985 | Otterbein | 261/153 |
| 4,955,435 | A * | 9/1990 | Shuster et al. | 165/170 |
| 5,050,671 | A * | 9/1991 | Fletcher | 165/166 |
| 5,143,658 | A * | 9/1992 | Thomas | 261/112.2 |
| 5,573,060 | A * | 11/1996 | Adderley et al. | 165/166 |
| 7,159,650 | B2 * | 1/2007 | Brost et al. | 165/167 |
| 2005/0046050 | A1 | 3/2005 | Palmer et al. | |
| 2009/0183862 | A1 * | 7/2009 | Benezech et al. | 165/170 |

* cited by examiner

*Primary Examiner* — Tho V Duong
(74) *Attorney, Agent, or Firm* — Dority & Manning, PA

(57) ABSTRACT

A media sheet for a heat exchanger is disclosed. The media sheet includes a first layer having a first outer surface and a second layer having a second outer surface. The first and second layers define a plurality of passages extending therebetween. At least one of the first and second outer surfaces comprises a plurality of depressions. The plurality of depressions further define the plurality of passages therebetween. The media sheet is polymer fiber-based and wettable.

19 Claims, 4 Drawing Sheets

HEAT EXCHANGER MEDIA PAD FOR A GAS TURBINE

FIELD OF THE INVENTION

The subject matter disclosed herein related generally to heat exchangers, and more particularly to media pads in heat exchangers.

BACKGROUND OF THE INVENTION

Gas turbines are widely utilized in fields such as power generation. A conventional gas turbine system includes a compressor, which compresses ambient air; a combustor for mixing compressed air with fuel and combusting the mixture; and a turbine, which is driven by the combustion mixture to produce power and exhaust gas.

Various strategies are known in the art for increasing the amount of power that a gas turbine is able to produce. One way of increasing the power output of a gas turbine is by cooling the ambient air before compressing it in the compressor. Cooling causes the air to have a higher density, thereby creating a higher mass flow rate into the compressor. The higher mass flow rate of air into the compressor allows more air to be compressed, allowing the gas turbine to produce more power. Additionally, cooling the ambient air generally increases the efficiency of the gas turbine.

Various systems and methods are utilized to cool the ambient air entering a gas turbine. For example, heat exchangers may be utilized to cool the ambient air through latent cooling or through sensible cooling. Many such heat exchangers utilize a media pad to facilitate cooling of the ambient air. These media pads allow heat and/or mass transfer between the ambient air and a coolant. The ambient air interacts with the coolant in the media pad, cooling the ambient air.

Known media pads for use in heat exchangers are formed from, for example, cellulose fibers. Cellulose fiber-based media pads generally include a stiffening agent designed to maintain the structural integrity of the media pad when a coolant, such as water, is flowed through the media pad. However, cellulose fiber-based media pads are generally not suitable in situations requiring a high volume of coolant, which may dissolve the stiffening agent and collapse the media pad. Further, cellulose fiber-based media pads may be particularly sensitive to the quality of coolant flowed therethrough, and may therefore require the use of "fouled" coolant rather than clean coolant for the media pad to perform properly.

Other known media pads are formed from non-porous, solid plastic materials. These media pads are generally not able to evenly and fully distribute coolant throughout the surface area of the pads. This can inhibit efficient cooling of the ambient air and, in some cases, may result in dry spots that cause hot streaks of air, which can be detrimental to the operation of the gas turbine compressor. Additionally, at relatively higher air flow velocities, these media pads may be unable to retain the coolant, and may instead have a tendency to shed coolant.

Thus, a media pad that provides more efficient cooling and is not sensitive to coolant quality would be desired in the art. Additionally, a media pad that will maintain structural integrity when a high volume of coolant is flowed therethrough would be advantageous. Further, a media pad that reduces or prevents dry spots and resulting hot streaks would be desired.

Finally, a media pad that retains coolant at relatively higher air flow velocities would be advantageous.

BRIEF DESCRIPTION OF THE INVENTION

Aspects and advantages of the invention will be set forth in part in the following description, or may be obvious from the description, or may be learned through practice of the invention.

In one embodiment, a media sheet for a heat exchanger is disclosed. The media sheet includes a first layer having a first outer surface and a second layer having a second outer surface. The first and second layers define a plurality of passages extending therebetween. At least one of the first and second outer surfaces comprises a plurality of depressions. The plurality of depressions further define the plurality of passages therebetween. The media sheet is polymer fiber-based and wettable.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
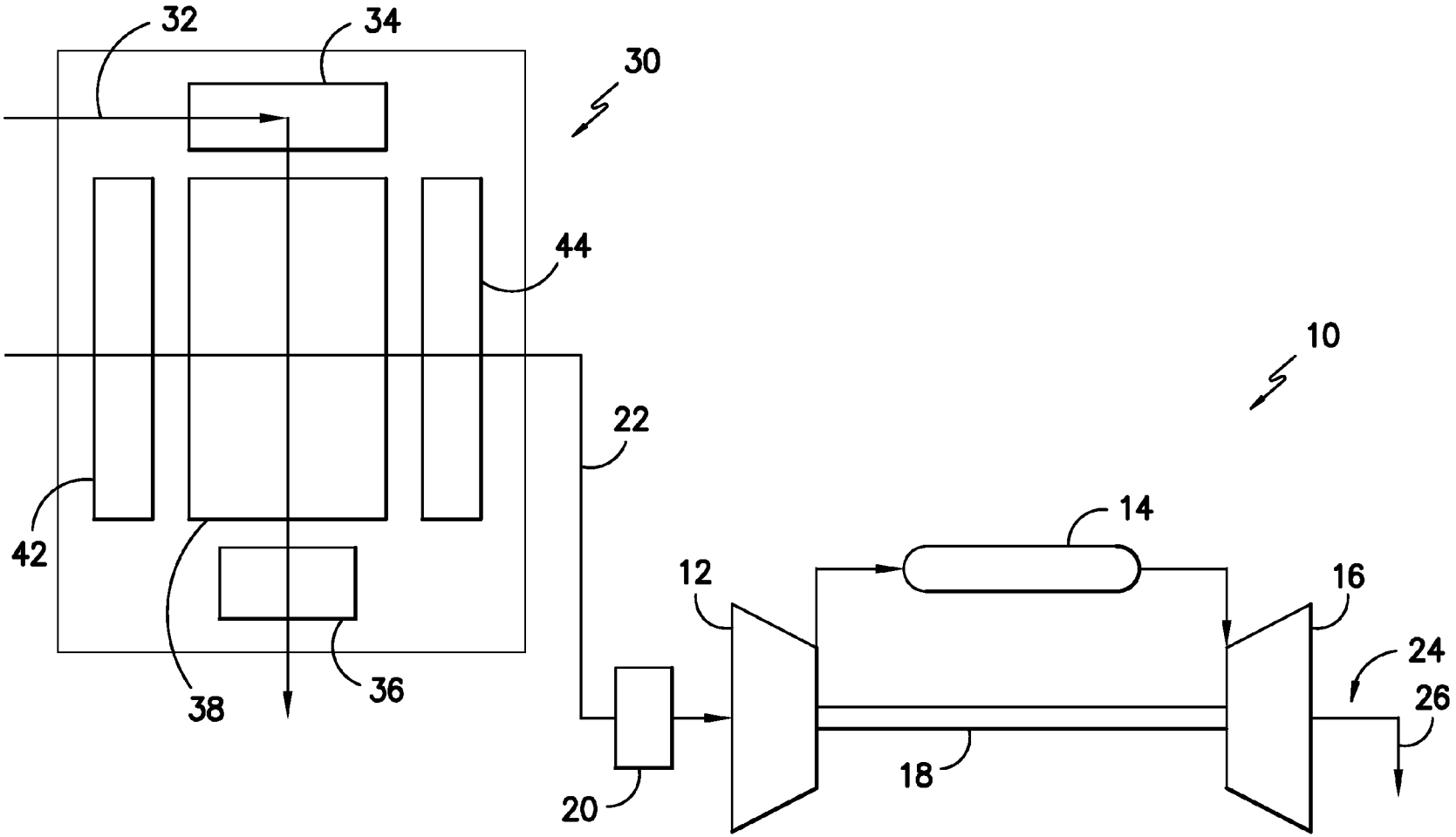
FIG. 1 is a schematic illustration of a gas turbine system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, combustor 14, and turbine 16. Further, the system 10 may include a plurality of compressors 12, combustors 14, and turbines 16. The compressor 12 and turbine 16 may be coupled by a shaft 18. The shaft 18 may be a single shaft or a plurality of shaft segments coupled together to form shaft 18.

The system 10 may further include a gas turbine inlet 20. The inlet 20 may be configured to accept an inlet flow 22. For example, in one embodiment, the inlet 20 may be a gas turbine inlet house. Alternatively, the inlet 20 may be any portion of the system 10, such as any portion of the compressor 12 or any apparatus upstream of the compressor 12, which may accept the inlet flow 22. The inlet flow 22 may, in exemplary embodiments, be ambient air, which may be conditioned or unconditioned. Alternatively, the inlet flow 22 may be any suitable fluid, and may preferably be any suitable gas.

The system 10 may further include an exhaust outlet 24. The outlet 24 may be configured to discharge gas turbine exhaust flow 26. In some embodiments, the exhaust flow 26 may be directed to a heat recovery steam generator (not shown). Alternatively, the exhaust flow 26 may be, for example, directed to an absorption chiller (not shown) or dispersed into ambient air.

The system 10 may further include a heat exchanger 30. It should be understood that the heat exchanger 30 of the present disclosure is not limited to applications in systems 10. Rather, use of a heat exchanger 30 in any system requiring a heat exchange operation is within the scope and spirit of the present disclosure.

The heat exchanger 30 may be configured to cool the inlet flow 22 before the inlet flow 22 enters the compressor 12. For example, the heat exchanger 30 may be disposed in the gas turbine inlet 20, or may be upstream or downstream of the gas turbine inlet 20. The heat exchanger 30 may allow the inlet flow 22 and a heat exchange medium 32 to flow therethrough, and may facilitate the interaction of the inlet flow 22 and the heat exchange medium 32 to cool the inlet flow 22 before it enters the compressor 12. The heat exchange medium 32 may, in exemplary embodiments, be water. Alternatively, the heat exchange medium 32 may be any suitable fluid, and may preferably be any suitable liquid.

The heat exchanger 30 may, in exemplary embodiments, be a direct-contact heat exchanger 30. The heat exchanger 30 may include a heat exchange medium inlet 34, a heat exchange medium outlet 36, and a media pad 38. The inlet 34 may flow the heat exchange medium 32 to the media pad 38. For example, in one embodiment, the inlet 34 may be a nozzle or a plurality of nozzles. The outlet 36 may accept heat exchange medium 32 exhausted from the media pad 38. For example, in one embodiment, the outlet 36 may be a sump disposed downstream of the media pad 38 in the direction of flow of the heat exchange medium 32. In an exemplary embodiment, heat exchange medium 32 may be directed in a generally or approximately downward direction from inlet 34 through media pad 38, and inlet flow 22 may be directed through the heat exchanger 30 in a direction generally or approximately perpendicular to the direction of flow of the heat exchange medium 32.

In some embodiments, a filter 42 may be disposed upstream of the media pad 38 in the direction of inlet flow 22. The filter 42 may be configured to remove particulate from the inlet flow 22 prior to the inlet flow 22 entering the media pad 38, thus preventing the particulate from entering the system 10. Alternatively or additionally, a filter 42 may be disposed downstream of the media pad 38 in the direction of inlet flow 22. The filter 42 may be configured to remove particulate from the inlet flow 22 prior to the inlet flow 22 entering the system 10.

In some embodiments, a drift eliminator 44 may be disposed downstream of the media pad 38 in the direction of inlet flow 22. The drift eliminator 44 may act to remove droplets of heat exchange medium 32 from the inlet flow 22 prior to the inlet flow 22 entering the system 10.

The heat exchanger 30 may, in some embodiments, be configured to cool the inlet flow 22 through latent, or evaporative, cooling. Latent cooling refers to a method of cooling where heat is removed from a gas, such as air, resulting in a change in the moisture content of the gas. Latent cooling may involve the evaporation of a liquid at ambient temperature to cool the gas. Latent cooling may be utilized to cool a gas to near its wet bulb temperature.

In alternative embodiments, the heat exchanger 30 may be configured to chill the inlet flow 22 through sensible cooling. Sensible cooling refers to a method of cooling where heat is removed from a gas, such as air, resulting in a change in the dry bulb and wet bulb temperatures of the air. Sensible cooling may involve chilling a liquid, and then using the chilled liquid to cool the gas. Sensible cooling may be utilized to cool a gas to below its wet bulb temperature.

It should be understood that latent cooling and sensible cooling are not mutually exclusive cooling methods, and may be applied either exclusively or in combination. It should further be understood that the heat exchanger 30 of the present disclosure is not limited to latent cooling and sensible cooling methods, but may cool, or heat, the inlet flow 22 through any suitable cooling or heating method.

Figure 2:
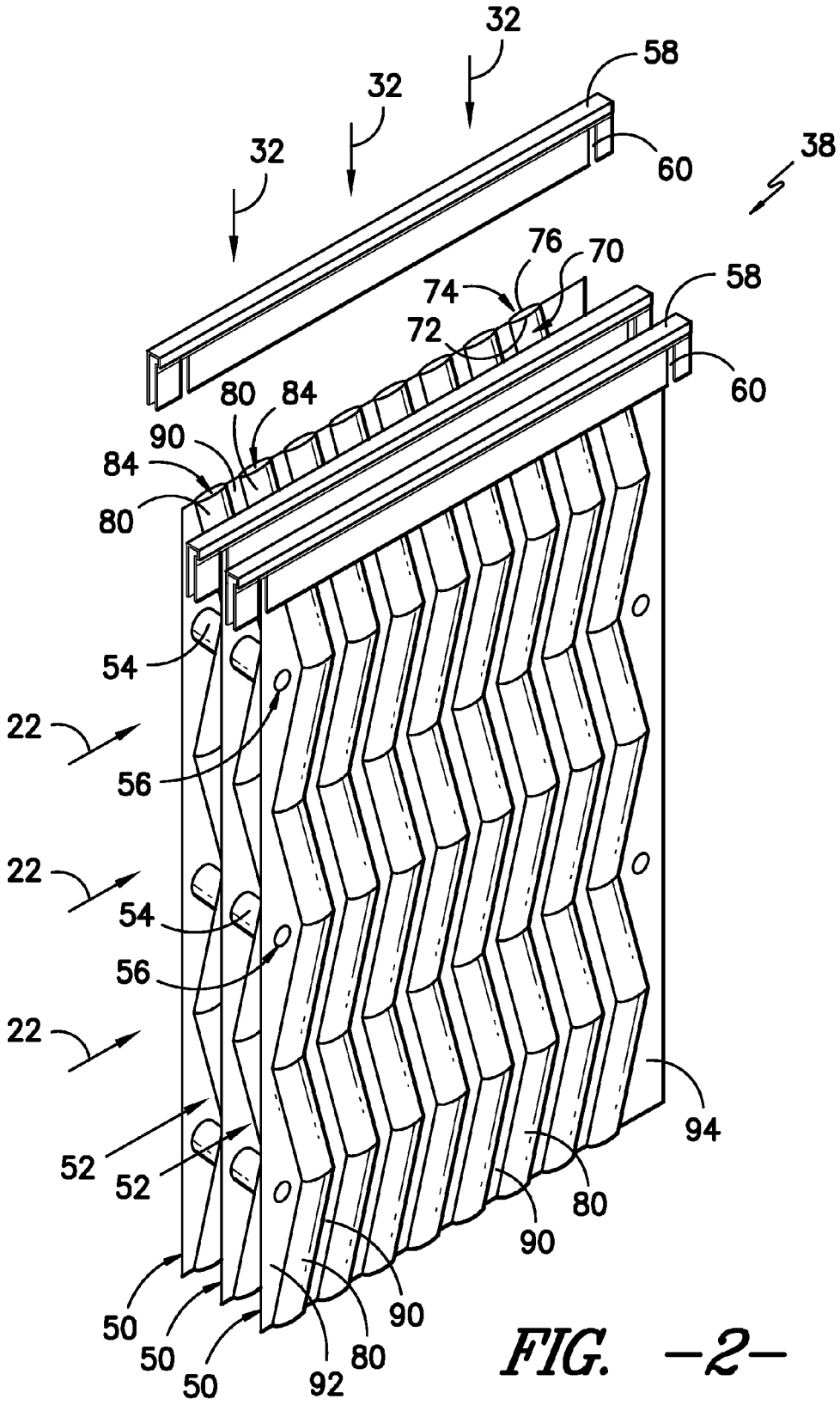
FIG. 2 is a perspective view of one embodiment of a media pad of the present disclosure.

Referring now to FIG. 2, a media pad 38 according to one embodiment of the present disclosure is illustrated. The media pad 38 may include at least one, or a plurality of, media sheets 50. The media sheets 50 may be spaced apart from each other to define a plurality of inlet flow passages 52 therebetween. Each of the plurality of inlet flow passages 52 may thus be configured to flow inlet flow 22 therethrough. For example, inlet flow 22 entering the media pad 38 may flow through the inlet flow passages 52. Further, as discussed below, each of the plurality of media sheets 50 may be configured to flow heat exchange medium 32 therethrough. The plurality of media sheets 50, and thus the media pad 38, may thus allow the inlet flow 22 to interact with the heat exchange medium 32, cooling or heating the inlet flow 22.

The media pad 38 may further include a plurality of spacers 54. The spacers 54 may at least partially define the inlet flow passages 52. For example, each of the spacers 54 may be associated with at least one media sheet 50, and in some embodiments a plurality of media sheets 50. In one embodiment as shown in FIG. 2, the spacers 54 may be fastened to the media sheets 50 through apertures 56 defined in the media sheets 50. Additionally or alternatively, the spacers 54 may be fastened to the media sheets 50 through bonding, as discussed below, or through any suitable fastening device. The spacers 54 may generally extend between the associated media sheet 50 and other media sheets 50, spacing the media sheets 50 from each other and thus at least partially defining the inlet flow passages 52.

The media pad 38 may further include a plurality of mounts 58. In one embodiment, as shown in FIG. 2, each of the mounts 58 may be associated with one of the media sheets 50. In general, the mounts 58 may allow for mounting of the media sheets 50, and thus the media pad 38, in the heat exchanger 30. Further, the mounts 58 may provide for simple and efficient on-site installation and replacement of the media sheets 50. As shown, the mounts 58 may each include slots 60. The slots 60 may be provided to enable mounting of the media sheets 50, as discussed above. Additionally or alternatively, the mounts 58 may each include any suitable mounting devices that may allow for mounting the media sheets 50 in the heat exchanger 30.

The spacers 54 and mounts 58 may further allow the media sheets 50 to be adjustable within the heat exchanger, and relative to each other, if desired. For example, during operation of the system 10 during relatively hotter periods, such as during the summer or in the afternoon, the spacers 54 and mounts 58 may be utilized to position the media sheets 50, and thus the media pad 38, for optimal cooling or heating of the inlet flow 22. During relatively cooler periods, however, such as during the winter or in the evening, cooling or heating of the inlet flow 22 may not be required. In these situations, the spacers 54 may be removed and/or the mounts 58 utilized to adjust the media sheets 50 out of the flow path of the inlet flow 22. Thus, the media sheets 50 and media pad 38 may be adjustable as desired for optimal and efficient performance of the system 10.

FIGS. 3 through 6 illustrate various embodiments of a media sheet 50 of the present disclosure. The media sheet 50 may include, for example, a first layer 70 having a first outer surface 72 and a second layer 74 having a second outer surface 76. Further, the media sheet 50 may include an inner layer or inner layers (not shown) between the first layer 72 and the second layer 74. In exemplary embodiments, each of the layers 70, 74 may be a separate sheet of media material. Alternatively, the layers 70, 74 may be portions of a singular sheet of media material which may be, for example, folded to form the various layers 70, 74, or the layers 70, 74 may be formed from a singular sheet of media material by separating the sheet into layers, such as through cutting the sheet through the thickness of the sheet to define various portions of the media sheet 50 and thus define the layers 70, 74.

The first and second layers 70, 74 may generally define the periphery 78 of the media sheet 50. The media sheet 50 may be, in exemplary embodiments, generally rectangular. Alternatively, however, the media sheet 50 may be, for example, circular or oval, triangular, or any other suitable polygonal shape.

The media sheet 50 may, in general, be a polymer fiber-based media sheet 50 and, as discussed below, may be wettable. For example, the media sheet 50 may be formed from polyacrylates, polyamides (such as, for example, nylon), polyesters, polycarbonates, polyimides, polystyrenes, polyethylenes, polyurethanes, polyvinyls, polyolefins, or any other suitable polymer fibers. Further, the media sheet 50 may be, for example, a woven product or a non-woven product, and may be formed using any suitable processes, including, for example, wet-laying, spin-laying, air-laying, spin-blowing, melt-blowing, weaving, knitting, and/or sewing. The media pad 38 may thus generally be utilized with any variety of heat exchange mediums 32, and may not be sensitive to the quality of the heat exchange medium 32. For example, in one exemplary embodiment, the heat exchange medium 32 may be pure water, and the pure water may not require any fouling. Of course, it should be understood that fouled water, or any other suitable pure or fouled fluid, may be utilized as the heat exchange medium 32. Further, the media pad 38 may thus generally maintain its structural integrity when provided with a high volume of heat exchange medium 38, rather than collapsing or dissolving.

It should further be understood that the media sheets 50 may be formed from copolymers, and may further be composite media sheets 50. For example, the media sheets 50 may include any suitable metals, such as, for example, steel, aluminum, brass, or other metals or metal alloys, or ceramics, such as, for example, glass or other suitable ceramics or ceramic composites. The metals and/or ceramics may be, for example, strands that are embedded in the polymer fiber-based media sheets 50 to provide beneficial heat exchange medium 32 distribution properties or strength properties.

The first and second layers 70, 74 may define a plurality of passages 80 extending therebetween. For example, the passages 80 may be defined by both the first and second layers 70, 74, as shown in FIGS. 2 through 6, or may be defined by one of the first and second layers 70, 74, and an inner layer. The passages 80 may be configured to flow heat exchange medium 32 therethrough. Further, the heat exchange medium 32 in the passages 80 may pass through the passages 80 and flow to the remainder of the media sheet 50, thus wetting the remainder of the media sheet 50, as discussed below.

Figure 4:
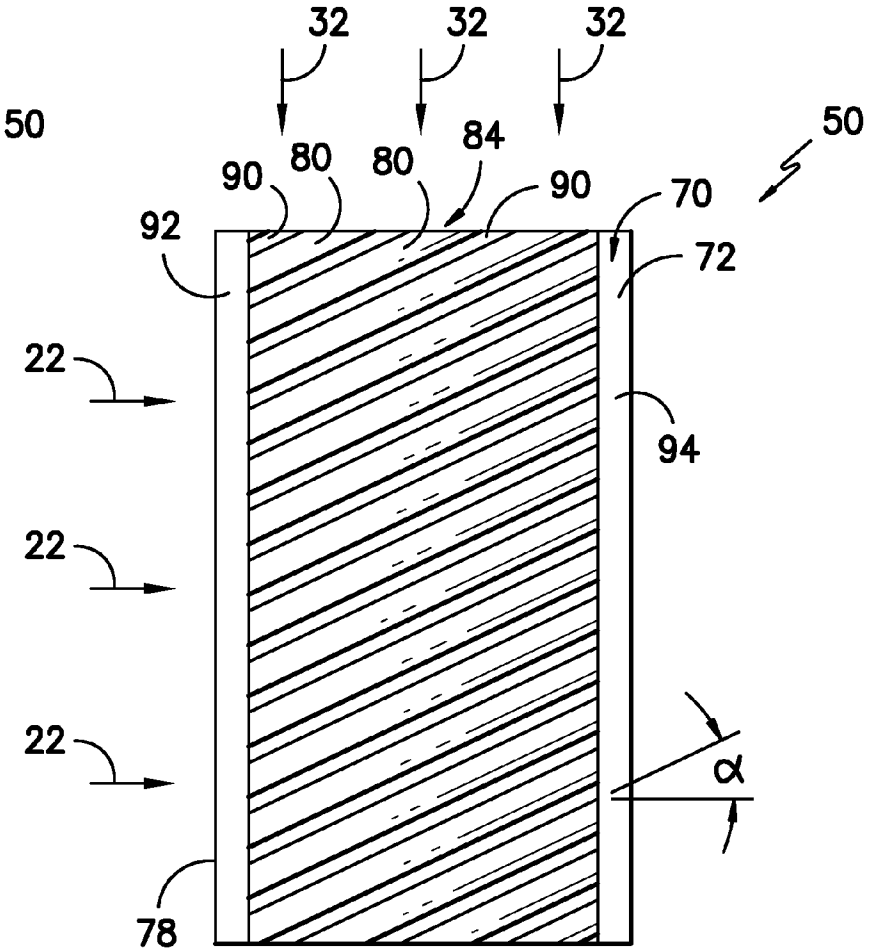
FIG. 4 is a front view of another embodiment of a media sheet of the present disclosure.
Figure 3:
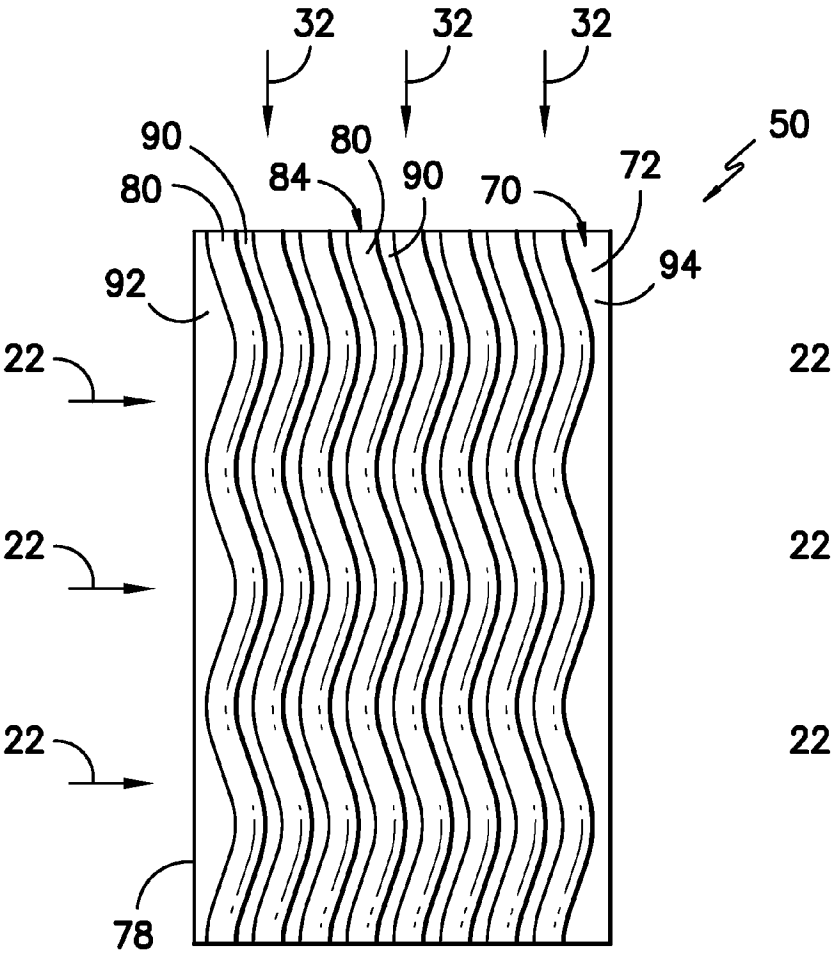
FIG. 3 is a front view of one embodiment of a media sheet of the present disclosure.

The passages 80 may extend in any variety of directions and patterns through the media sheet 50. For example, in one embodiment as shown in FIG. 2, the passages 80 extend generally vertically through the media sheet 50 with a sharp "zig-zag" pattern. In another embodiment as shown in FIG. 3, the passages 80 extend generally vertically through the media sheet 50 with a smooth "zig-zag" pattern. FIG. 4 illustrates another embodiment wherein the passages 80 extend generally diagonally through the media sheet 50 at angle $\alpha$. It should be understood that the passages 80 may extend through the media sheet 50 at any angle $\alpha$, such as, for example, at any angle from 0° (generally horizontal) to 90° (generally vertical).

Figure 6:
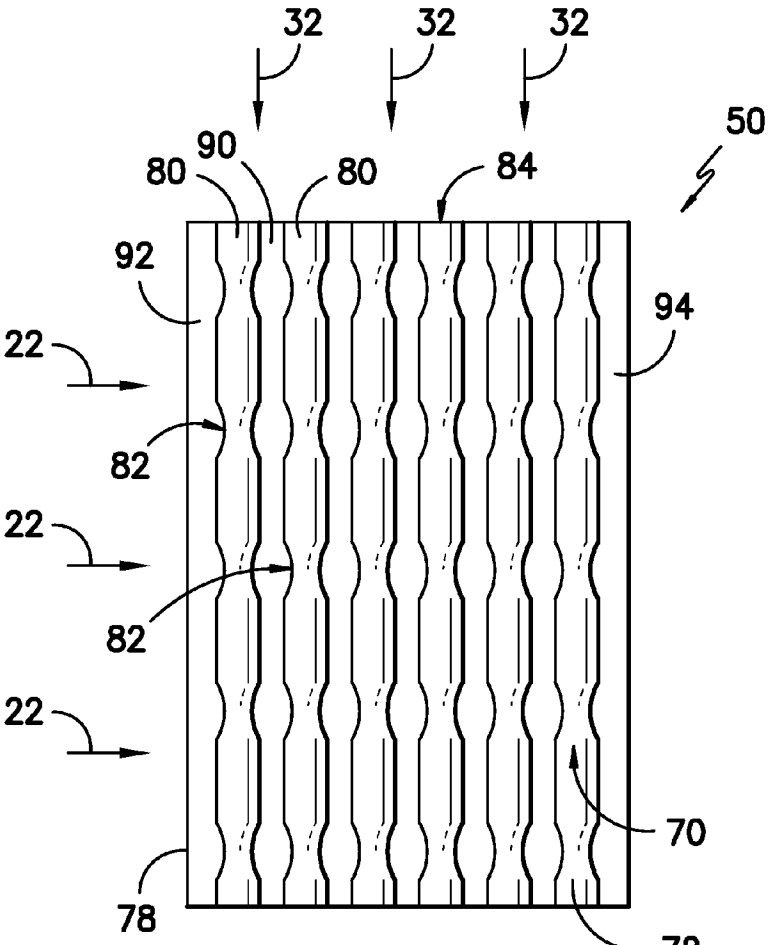
FIG. 6 is a front view of another embodiment of a media sheet of the present disclosure.
Figure 5:
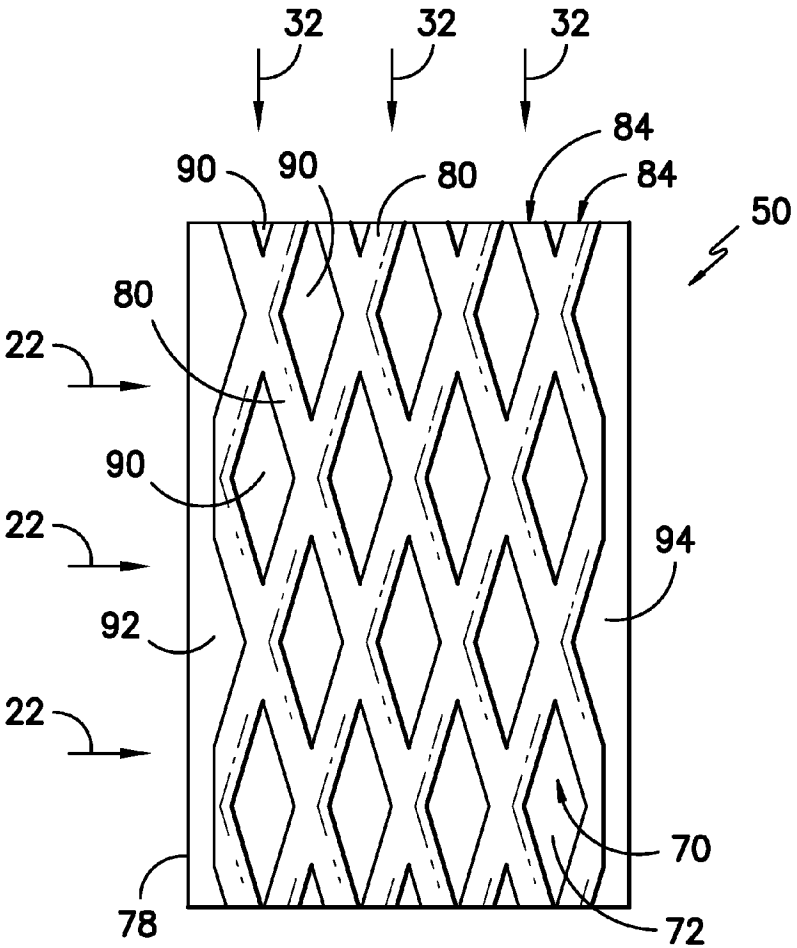
FIG. 5 is a front view of another embodiment of a media sheet of the present disclosure.

FIG. 5 illustrates another embodiment wherein the passages 80 extend generally diagonally through the media sheet 50, and wherein various of the passages 80 are fluidly connected. For example, the passages 80 extending diagonally through the media sheet 50 may intersect at various points on the media sheet 50, and may be fluidly connected at these points. FIG. 6 illustrates another embodiment wherein the passages 80 extend generally vertically through the media sheet 50, and wherein various of the passage 80 include restriction portions 82. A restriction portion 82 may be a portion of the passage 80 that has a generally smaller diameter or width than the remainder of the passage 80. The restriction portions 82 may be provided to regulate the flow of heat exchange medium 32 through the media sheet 50.

It should be understood that the passages 80 may have any suitable patterns, and may be of any suitable size, for flowing heat exchange medium 32 therethrough. It should additionally be understood that the passages 80 may be tapered, or may have any other modifications or alterations, along the lengths of the passages 80. Further, it should be understood that the passages 80 may extend to the periphery 78 of the media sheet 50, or may extend only partially through the media sheet 50, not reaching the periphery 78. Finally, it should be understood that each passage 80 may vary from the other various passages 80, and that the passages 80 defined in a media sheet 50 need not be identical.

In exemplary embodiments, at least a portion of the plurality of passages 80 may each include an inlet opening 84. The inlet openings 84 may be configured to accept heat exchange medium 32. For example, at least a portion of the heat exchange medium 32 flowed to the media pad 38 from the inlet 34 may be directed to various of the inlet openings 84. The heat exchange medium 32 may be accepted by the inlet openings 84 to be flowed through the passages 80.

At least one of the first and second outer surfaces 72, 76, and in exemplary embodiments both the first and second outer surfaces 72, 76, may comprise a plurality of depressions 90. The depressions 90 may generally define the plurality of passages 80 therebetween. For example, in exemplary embodiments, the depressions 90 may be formed through bonding, molding, forming, or drawing, or otherwise attaching or producing, and the resulting portions of the media sheet 50 that do not form the depressions 90 may form the passages 80. Alternatively, the passages 80 may be formed by, for example, cutting the passages 80 into the media sheet 50 through the thickness of the media sheet. The remainder of the media sheet 50 not including the passages 80 may be considered to include depressions 90.

As mentioned, the depressions 90 may be formed through, for example, bonding, molding, forming, or drawing, or any other suitable process for attaching or producing the various layers of the media sheet 50, including the first layer 70 and second layer 74. For example, bonding may include thermal bonding, physical or mechanical bonding (such as through pressing), ultrasonic bonding, chemical bonding, or weaving, knitting, needling, or sewing, or bonding through the use of an adhesive. Forming may include, for example, cold forming, roll forming, vacuum forming, or thermoforming. Bonding, molding, forming, drawing or otherwise attaching or producing the various layers of the media sheet 50 to create depressions 90 may form passages 80 therebetween.

The plurality of depressions 90 fanned in the media sheet 50 may include an inlet depression 92 and an outlet depression 94. The inlet and outlet depressions 92, 94 may be depressions defined adjacent the periphery 78 of the media sheet 50. For example, the inlet depression 92 may be defined adjacent the periphery 78 at the upstream edge of the media sheet 50 with respect to the inlet flow 22, such as where the inlet flow 22 may first interact with the media sheet 50 and media pad 38. The outlet depression 94 may be defined adjacent the periphery 78 at the downstream edge of the media sheet 50 with respect to the inlet flow 22, such as where the inlet flow 22 may exit the media sheet 50 and media pad 38. The inlet and outlet depressions 92, 94 may reduce the pressure drop associated with the inlet flow 22 as the inlet flow travels through the media pad 38, and/or may be shaped to aid the heat transfer and mixing between the inlet flow 22 and the heat exchange medium 32, such as by creating a turbulent inlet flow 22. In one exemplary embodiment, the outlet channel 94 may be further configured to capture heat exchange medium 32 before the heat exchange medium 32 is exhausted from the media pad 38 with the inlet flow 22.

In exemplary embodiments, the media sheet 50 may be wettable. Thus, the media sheet 50 may be formed such that the heat exchange medium 32 may be able to maintain contact with the media sheet 50, and may further be able to spread throughout the media sheet 50. Further, the media sheet 50 may be hydrophilic and/or porous. Thus, the media sheet 50 may generally be able to accept, absorb, flow, and distribute heat exchange medium 32 throughout the surface area of the media sheet 50. For example, heat exchange medium 32 provided to the media sheet 50, such as provided by the inlets 34, may wet the media sheet 50 and flow through the media sheet 50. In exemplary embodiments, the heat exchange medium 32 may be distributed relatively evenly throughout the surface area of the media sheet 50, reducing or eliminating dry spots on the heat exchange medium 32. Further, heat exchange medium 32 flowed through the inlet openings 84 into the passages 80 may pass through the passages 80 and flow into and through the depressions 90, and heat exchange medium 32 flowed through the depressions 90 may pass from the depressions 90 into the passages 80.

The passages 80 may, in general, be raised portions of the media sheet 50 relative to the depressions 90. For example, the passages 80 may be raised portions of the first layer 70 and first outer surface 72, and/or may be raised portions of the second layer 74 and the second outer surface 76, relative to the depressions 90. Thus, the inlet flow passages 52 between media sheets 50 may be further defined by the depressions 90 and the raised passages 80. Thus, the inlet flow passages 52 may promote turbulent inlet flow 22 through the media pad 38, beneficially enhancing the heat exchange between the inlet flow 22 and the heat exchange medium 32. Further, as mentioned above, the inlet depressions 92 and outlet depressions 94 may reduce the pressure drop associated with the inlet flow 22 through the media pad 38.

Thus, the media pad 38 of the present disclosure may provide more efficient cooling or heating of inlet flow 22. Additionally, the media pad 38 may be utilized with any variety of heat exchange mediums 32, and may not be sensitive to the quality of the heat exchange medium 32. Finally, the media pad 38 of the present disclosure may maintain its structural integrity when provided with a high volume of heat exchange medium 38, and may beneficially absorb, flow, and distribute heat exchange medium 38 throughout the surface area of the media pad 38 and media sheets 50 therein, thus eliminating potentially dangerous dry spots and promoting the cooling or heating of inlet flow 22.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A media sheet assembly for a heat exchanger, the media sheet assembly comprising a media sheet, wherein the media sheet comprising a first layer having a first outer surface and a second layer having a second outer surface, the first and second layers defining a plurality of passages extending therebetween, wherein an orientation of each of the plurality of passages defined in the first layer is parallel to an orientation of that passage defined in the second layer, at least one of the first and second outer surfaces comprising a plurality of depressions, the plurality of depressions further defining the plurality of passages therebetween and formed by attachment of the first layer and the second layer together such that the first layer and the second layer are in contact at each of the plurality of depressions; and a mount connected to an edge defined by the first outer layer and the second outer layer, the mount comprising a plurality of slots for mounting the media sheet in the heat exchanger, and wherein the media sheet is polymer fiber-based and wettable and allows direct contact between an inlet flow and a heat exchange medium, and wherein at least a portion of the plurality of passages each include an inlet opening positioned at an edge defined by the first outer layer and the second outer layer and configured to accept the heat exchange medium.

2. The media sheet of claim 1, wherein the polymer fiber comprises a polyamide.

3. The media sheet of claim 1, wherein the polymer fiber comprises a polyester.

4. The media sheet of claim 1, wherein the media sheet comprises a composite.

5. The media sheet of claim 4, wherein the media sheet comprises a ceramic.

6. The media sheet of claim 4, wherein the media sheet comprises a metal.

7. The media sheet of claim 1, wherein the first outer surface and the second outer surface comprise the plurality of depressions.

8. The media sheet of claim 1, wherein at least a portion of the plurality of passages each include at least one restriction portion.

9. The media sheet of claim 1, wherein at least a portion of the plurality of passages are fluidly connected.

10. The media sheet of claim 1, the first and second layers further defining a media sheet periphery, wherein the plurality of depressions include an inlet depression and an outlet depression, the inlet depression and outlet depression each defined adjacent the periphery of the media sheet.

11. The media sheet of claim 1, wherein the plurality of depressions are formed by one of bonding, molding, forming, or drawing.

12. A heat exchanger comprising:

a media pad, the media pad comprising:

a plurality of polymer fiber-based, wettable media sheets, the plurality of media sheets spaced apart from each other to define a plurality of inlet flow passages therebetween, each of the plurality of media sheets including a first layer having a first outer surface and a second layer having a second outer surface, the first and second layers of each of the plurality of media sheets defining a plurality of passages extending therebetween, at least one of the first and second outer surfaces of each of the plurality of media sheets comprising a plurality of depressions, the plurality of depressions further defining the plurality of passages therebetween and formed by attachment of the first layer and the second layer of each of the plurality of media sheets together such that the first layer and the second layer are in contact at each of the plurality of depressions; and a mount connected to an edge of at least one of the plurality of media sheets, the mount comprising a plurality of slots for mounting the media sheet in the heat exchanger, and wherein the plurality of media sheets are each configured to flow heat exchange medium therethrough and the plurality of inlet flow passages are each configured to flow inlet flow therethrough, allowing the inlet flow to directly contact the heat exchange medium, and wherein at least a portion of the plurality of passages of at least one of the plurality of media sheets each include an inlet opening positioned at an edge of the media sheet and configured to accept heat exchange medium.

13. The heat exchanger of claim 12, further comprising a plurality of spacers, the spacers at least partially defining the inlet flow passages.

14. The heat exchanger of claim 12, wherein the polymer fiber comprises a polyamide.

15. The heat exchanger of claim 12, wherein the polymer fiber comprises a polyester.

16. The heat exchanger of claim 12, wherein the media sheet comprises a composite.

17. The heat exchanger of claim 16, wherein the media sheet comprises ceramic.

18. The heat exchanger of claim 16, wherein the media sheet comprises metal.

19. The heat exchanger of claim 12, wherein the plurality of depressions are formed by one of bonding, molding, forming, or drawing.

* * * * *